US010100497B2

(12) United States Patent
Izumikawa

(10) Patent No.: US 10,100,497 B2
(45) Date of Patent: Oct. 16, 2018

(54) SHOVEL

(71) Applicant: SUMITOMO (S.H.I.) CONSTRUCTION MACHINERY CO., LTD., Tokyo (JP)

(72) Inventor: Takeya Izumikawa, Chiba (JP)

(73) Assignee: SUMITOMO (S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 15/460,615

(22) Filed: Mar. 16, 2017

(65) Prior Publication Data

US 2017/0183845 A1 Jun. 29, 2017

Related U.S. Application Data

(63) Continuation of application No. PCT/JP2015/076485, filed on Sep. 17, 2015.

(30) Foreign Application Priority Data

Sep. 18, 2014 (JP) ..... 2014-190344

(51) Int. Cl.
*G01C 9/00* (2006.01)
*E02F 9/26* (2006.01)
(Continued)

(52) U.S. Cl.
CPC ..... *E02F 9/264* (2013.01); *E02F 3/32* (2013.01); *E02F 9/2037* (2013.01);
(Continued)

(58) Field of Classification Search
CPC .. E02F 9/26; E02F 9/264; E02F 3/435; G01C 25/00; G01C 9/00
See application file for complete search history.

(56) References Cited

U.S. PATENT DOCUMENTS 5,854,988 A 12/1998 Davidson et al.
2009/0312974 A1* 12/2009 Douglas ..... G01C 9/00 702/93
(Continued)

FOREIGN PATENT DOCUMENTS

EP 3020875 5/2016
JP H06-010374 1/1994
(Continued)

OTHER PUBLICATIONS

International Search Report for PCT/JP2015/076485 dated Dec. 22, 2015.

*Primary Examiner* — Yuri Kan
(74) *Attorney, Agent, or Firm* — IPUSA, PLLC

(57) ABSTRACT

A shovel includes a lower-part traveling body 1, an upper-part swiveling body 3 installed in the lower-part traveling body so as to be rotatable relative to the lower-part traveling body, an attachment attached to the upper-part swiveling body, and a machine guidance device 50 of reporting a visual report or an audible report of a value of a difference between a present position of an end attachment and a target position of the end attachment, wherein the shovel includes a controller 30 that reports possible discontinuity of an accurate guidance in a case where it is determined that a predetermined event occurs. The controller determines that the predetermined event occurs in a case where it is determined that a change occurs in a position of the lower-part traveling body or a posture of the lower-part traveling body, and reports the possible discontinuity of the accurate guidance to the operator.

5 Claims, 8 Drawing Sheets

(51) Int. Cl.
*E02F 3/32* (2006.01)
*E02F 9/20* (2006.01)
*E02F 9/22* (2006.01)

(52) U.S. Cl.
CPC ..... *E02F 9/2066* (2013.01); *E02F 9/2203* (2013.01); *E02F 9/2228* (2013.01); *E02F 9/2292* (2013.01)

(56) References Cited

U.S. PATENT DOCUMENTS

| | | | | |
|---|---|---|---|---|
| 2013/0158786 | A1 | 6/2013 | Fukano et al. | |
| 2016/0138249 | A1 | 5/2016 | Conway et al. | |
| 2016/0251834 | A1* | 9/2016 | Arimatsu ..... | E02F 3/435<br>414/687 |

FOREIGN PATENT DOCUMENTS

| | | |
|---|---|---|
| JP | H06-073755 | 3/1994 |
| JP | H10-103925 | 4/1998 |
| JP | 2001-098585 | 4/2001 |
| JP | 2004-132137 | 4/2004 |
| JP | 2013-161192 | 8/2013 |

* cited by examiner

SHOVEL

RELATED APPLICATION

The present application is a continuation application of International Application No. PCT/JP2015/076485, filed Sep. 17, 2015, which claims priority to Japanese Patent Application No. 2014-190344, filed Sep. 18, 2014. The contents of these applications are incorporated herein by reference in their entirety.

BACKGROUND

Technical Field

The present invention relates to a shovel into which a machine guidance function is installed.

Description of Related Art

There is a shovel including a system of graphically displaying a difference between a current position of a bucket and a target position of the bucket on a side view of the bucket in use of a two-dimensional machine guidance function that does not use information related to the position of the shovel in the world geodetic system (Japanese Laid-open Patent Publication No. Hei 10-103925).

SUMMARY

However, the above system does not assume a situation where the shovel unexpectedly tilts during a machine guidance or the position of the shovel unexpectedly shifts during the machine guidance in a case where a drilling operation is conducted on the uneven ground. If the change occurs in the position and the lean of the shovel, a reference position set based on the tip end position of the bucket 6 before starting the machine guidance is caused to shift. Therefore, the above system is not provided with an accurate machine guidance. However, a service of the machine guidance is not stopped. As a result, in the above system, even if the accurate machine guidance is not provided, an inaccurate machine guidance is possibly used.

In view of the above, it is preferred to provide a shovel that can report, if necessary, a possible inaccurate machine guidance.

A shovel according to an embodiment including a lower-part traveling body, an upper-part swiveling body installed in the lower-part traveling body so as to be rotatable relative to the lower-part traveling body, and an attachment attached to the upper-part swiveling body, wherein the shovel performs a machine guidance function of reporting a visual report or an audible report of a value of a difference between a present position of an end attachment and a target position of the end attachment, wherein the shovel includes a control apparatus that reports a possible discontinuity of an accurate guidance in a case where it is determined that a predetermined event occurs.

By the above measure, there is provided a shovel that can report, if necessary, a possible inaccurate machine guidance.

DETAILED DESCRIPTION

Figure 1:
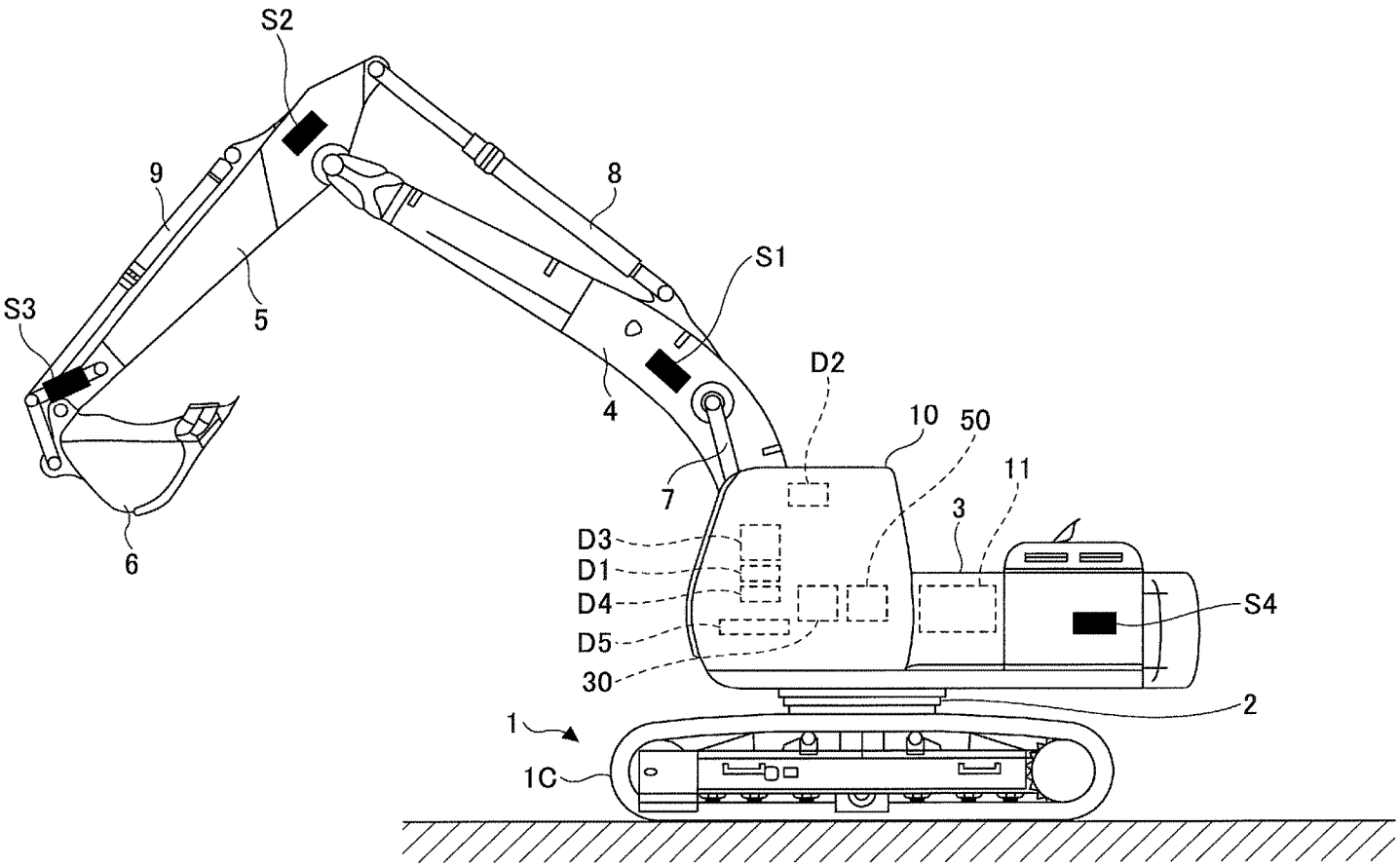
FIG. 1 is a side view of a shovel of an embodiment of the present invention.

FIG. 1 is a side view of a shovel as an example of a construction machine of an embodiment of the present invention. In the shovel, an upper-part swiveling body 3 is installed in a lower-part traveling body 1 through a swivel mechanism 2 so as to be rotatable relative to the lower-part traveling body 1. A boom 4 is attached to the upper-part swiveling body 3. An arm 5 is attached to a tip of the boom 4, and a bucket 6 as an end attachment is attached to a tip of the arm 5. The end attachment may be a bucket for slope of embankment, a dredge bucket, a breaker, or the like.

The boom 4, the arm 5, and the bucket 6 form a drilling attachment as an example, and hydraulically driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6. The drilling attachment may be provided with a bucket tilt mechanism.

The boom angle sensor S1 is a sensor for detecting a turning angle of the boom 4. Within the embodiment, the boom angle sensor S1 is an acceleration sensor that detects an inclination of the boom relative to the horizontal face to detect the turning angle of the boom 4 along a boom foot pin connecting the upper-part swiveling body 3 with the boom 4. The arm angle sensor S2 is a sensor detecting the turning angle of the arm 5. Within this embodiment, the arm angle sensor S2 detects an inclination of the arm 5 relative to the horizontal face to detect a turning angle of the arm 5 around a connection pin that connects the boom 4 with the arm 5. The bucket angle sensor S3 is a sensor for detecting a turning angle of the bucket 6. Within this embodiment, the bucket angle sensor S3 detects an inclination of the bucket 6 relative to the horizontal face to detect a turning angle of the bucket 6 around a connection pin that connects the arm 5 with the bucket 6. In a case where the drilling attachment has a bucket tilt mechanism, the bucket angle sensor S3 additionally detects the turning angle of the bucket 6 around a tilt shaft. At least one of the boom angle sensor S1, the arm angle sensor S2, and the bucket angle sensor S3 may be a potentiometer using a variable resistor, a stroke sensor detecting a stroke amount of a corresponding hydraulic cylinder, a rotary encoder detecting the turning angle around the connection pin, or the like.

The upper-part swiveling body 3 includes a cabin 10 and a power source such as an engine. Further, the body inclination sensor S4 is attached to the upper-part swiveling body 3. An input apparatus D1, a sound output apparatus D2, a display apparatus D3, a memory apparatus D4, agate lock lever D5, a controller 30, a machine guidance device 50 are installed inside the cabin 10.

The controller 30 is a control apparatus as a main control unit for performing a drive control of the shovel. Within the embodiment, the controller 30 is formed by an arithmetic processing unit including a CPU and an internal memory. Various functions of the controller 30 are implemented when the CPU executes a program stored in an internal memory.

The machine guidance device 50 is provided to guide the operation of the shovel. Within the embodiment, the machine guidance device 50 guides the operations for the operator by visually and audibly reporting a distance between the surface of a target land form set by the operator and the tip (a claw end) of the bucket 6 in the vertical direction to the operator, for example. The machine guidance device 50 may visually or audibly report the distance to the operator. Specifically, the machine guidance device 50 includes an arithmetic processing unit including a CPU and an internal memory in a manner similar to the effect of the controller 30. Various functions of the machine guidance device 50 are implemented when the CPU executes a program stored in an internal memory.

The body inclination sensor S4 is a sensor of detecting an inclination of the upper-part swiveling body 3 relative to the horizontal face. Within the embodiment, the body inclination sensor S4 is a biaxial acceleration sensor detecting inclination angles around an anterior-posterior axis and a left-right axis of the upper-part swiveling body 3.

The input apparatus D1 is provided for the operator of the shovel to input various information into the machine guidance device 50. Within the embodiment, the input apparatus D1 is a membrane switch attached to the surface of the display apparatus D3. The input apparatus D1 may be a touch panel.

The sound output apparatus D2 outputs various sound information in response to a sound output command from the machine guidance device 50. Within the embodiment, an onboard speaker directly connected to the machine guidance device 50 is used as the sound output apparatus D2. A buzzer may be used as the sound output apparatus D2.

The display apparatus D3 outputs various image information in response to the command from the machine guidance device 50. Within the embodiment, an LCD monitor directly connected to the machine guidance device 50 is used as the display apparatus D3.

The memory apparatus D4 stores various information. Within the embodiment, the memory apparatus D4 is a non-volatile storage such as a semiconductor memory that stores various information output from the machine guidance device 50 or the like.

The gate lock lever D5 is a mechanism of preventing the shovel from being erroneously operated. The gate lock lever D5 can be switched over between a first state and a second state. In a case where the gate lock lever D5 is switched to the first state, various operation apparatuses are effective. In a case where the gate lock lever D5 is switched to the second state, various operation apparatuses are ineffective. Within the embodiment, the gate lock lever D5 is arranged between a door of a cabin 10 and a driver's seat. In a case where the gate lock lever D5 is pulled up so that the operator cannot go out of the cabin 10, various operation apparatuses are made effective. In a case where the gate lock lever D5 is pushed down so that the operator can go out of the cabin 10, various operation apparatuses are made ineffective.

Figure 2:
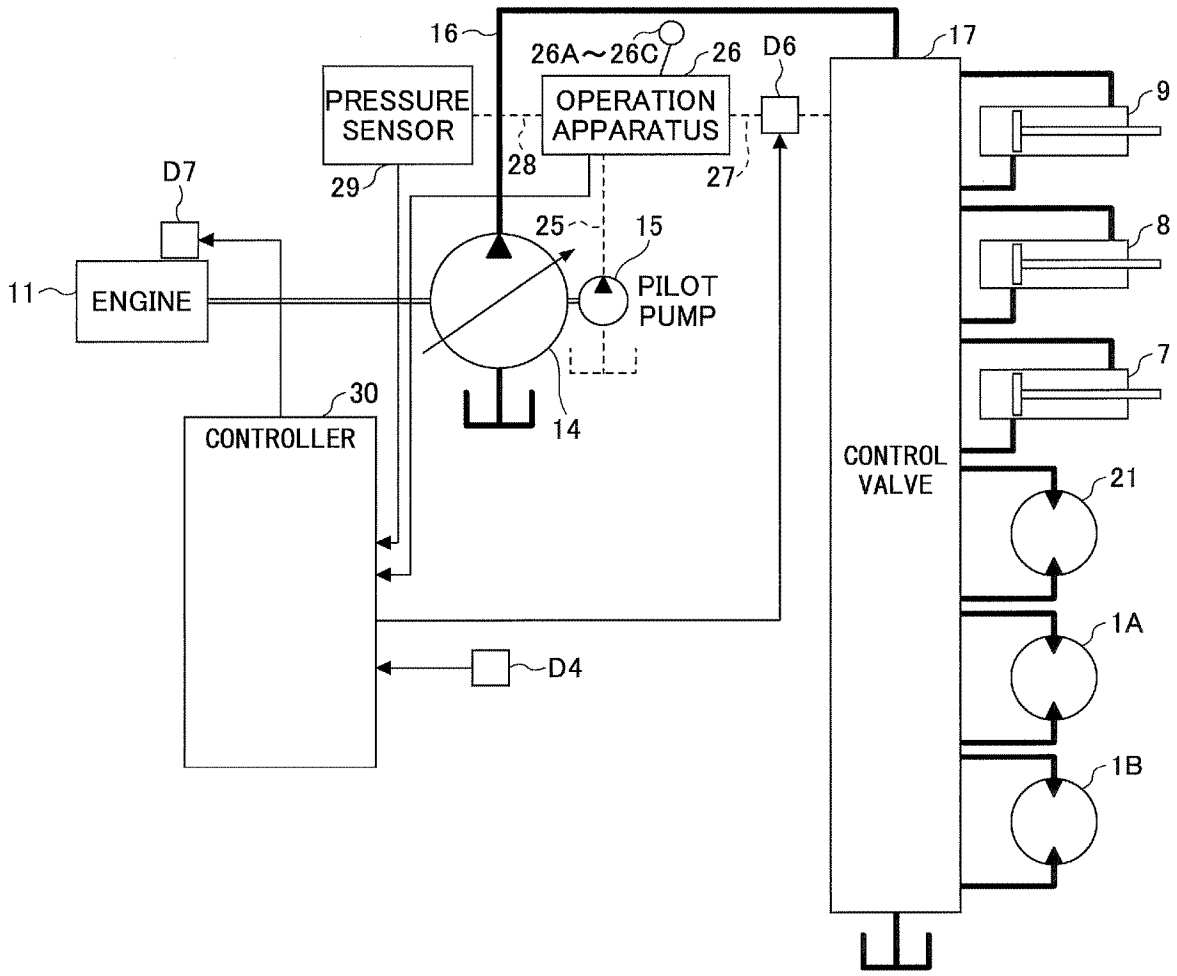
FIG. 2 is a block diagram illustrating an exemplary structure of a drive system of the shovel illustrated in FIG. 1.

FIG. 2 is a block diagram illustrating an exemplary structure of a drive system of the shovel illustrated in FIG. 1. Referring to FIG. 2, a mechanical power system is indicated by a double line, a high-pressure hydraulic line is indicated by a thick solid line, a pilot line is indicated by a dash line, and an electrical drive and control system is indicated by a thin solid line.

The engine 11 is a power source of the shovel. Within the embodiment, the engine 11 is a diesel engine applied with an isochronous control by which the engine revolution speed is maintained to be constant regardless of an increase or a decrease of the engine load. An engine controller D7 controls a fuel injection amount, a fuel injection timing, a boost pressure, or the like.

The engine controller D7 controls the engine 11. Within the embodiment, the engine controller D7 performs various functions such as an auto idling function and an auto idling stop function.

The auto idling function is to reduce the engine revolution speed from an ordinary revolution speed (e.g., 2000 rpm) to an idling revolution speed (e.g., 2000 rpm) in a case where a predetermined condition is satisfied. Within the embodiment, the engine controller D7 causes the auto idling function to be operated to reduce the engine revolution speed to the idling revolution speed in response to the auto idling command from the controller 30.

The auto idling stop function is to stop the engine 11 in a case where a predetermined condition is satisfied. Within the embodiment, the engine controller D7 causes the auto idling stop function to be operated to stop the engine 11 in response to the auto idling stop command from the controller 30.

A main pump 14 and a pilot pump 15 are hydraulic pumps connected to the engine 11. A control valve 17 is connected to the main pump 14 through a high-pressure hydraulic line 16.

The control valve 17 is a control apparatus that controls a hydraulic system of the shovel. Hydraulic actuators such as a right hydraulic traveling motor 1A, a left hydraulic traveling motor 1B, a boom cylinder 7, an arm cylinder 8, a bucket cylinder 9, and a hydraulic swiveling motor 21 are connected to a control valve 17 through a high-pressure hydraulic line.

An operation apparatus 26 is connected to the pilot pump 15 through a pilot line 25.

The operation apparatus 26 includes a lever 26A, a lever 26B, and a pedal 26C. Within the embodiment, the operation apparatus 26 is connected to the control valve 17 through a hydraulic line 27 and a gate lock valve D6. The operation apparatus 26 is connected to a pressure sensor 29 through a hydraulic line 28.

A gate lock valve D6 is provided to switch over between connection and shutoff of the hydraulic line 27 that connects the control valve 17 to the operation apparatus 26. Within the embodiment, the gate lock valve D6 is an electromagnetic valve that switches over between connection and shutoff of the hydraulic line 27 in response to a command from the controller 30. The controller 30 determines the state of the gate lock lever D5 based on a state signal output by the gate lock lever D5. In a case where the gate lock lever D5 is determined to exist in the first state, a connection command is output to the gate lock valve D6 to open the gate lock valve D6 to cause the hydraulic line 27 to be passed through. As a result, an operation by the operator to the operation apparatus 26 becomes effective. In a case where the gate lock lever D5 is determined to exist in the second state, a shutoff command is output to the gate lock valve D6 to close the gate lock valve D6 to cause the hydraulic line 27 to be blocked. As a result, an operation by the operator to the operation apparatus 26 becomes effective.

The pressure sensor 29 detects an operation content of operating the operation apparatus 26 in a form of pressure, and a detected value is output to the controller 30.

Figure 3:
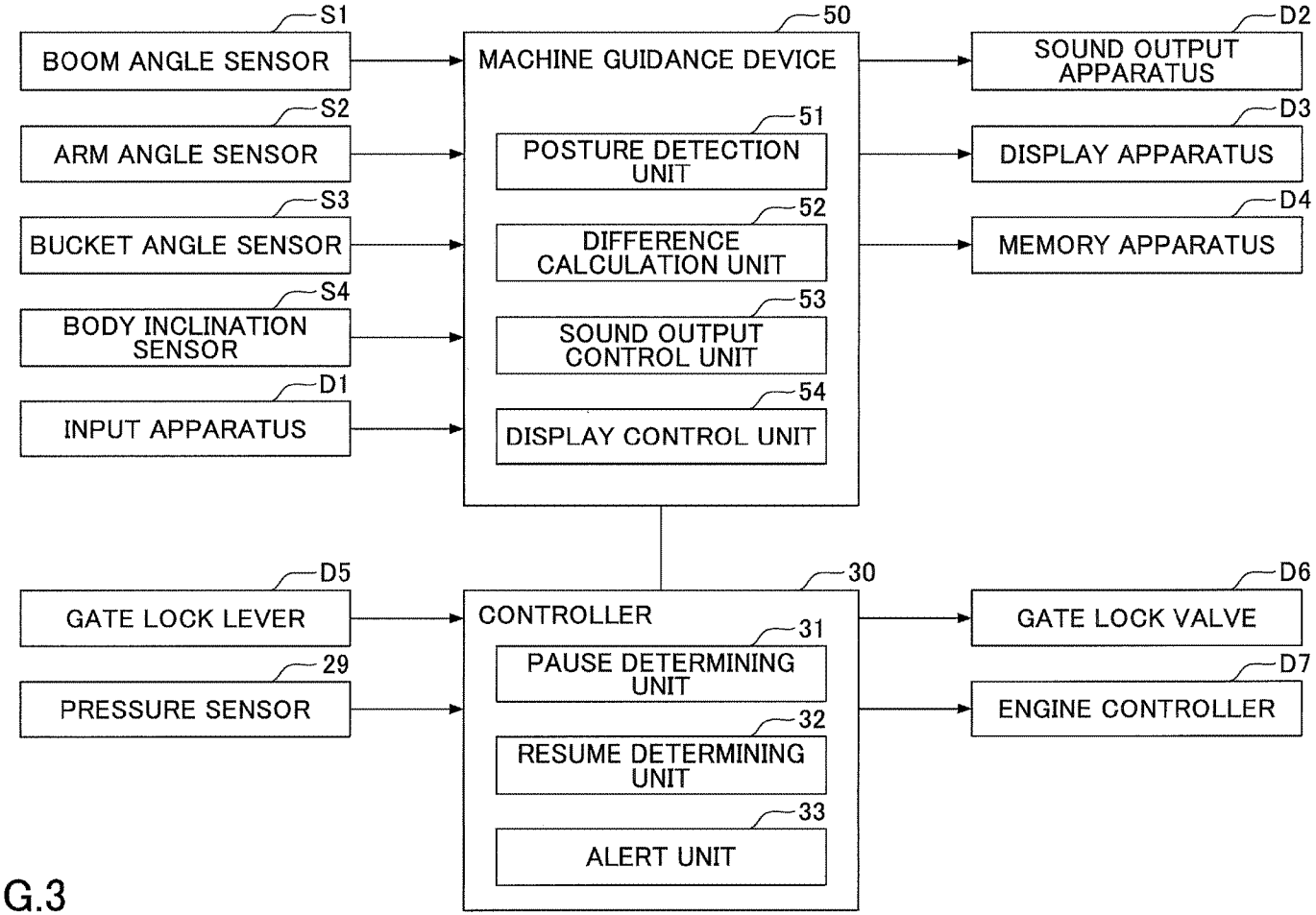
FIG. 3 is a functional block diagram for illustrating exemplary structures of a controller and a machine guidance device.

Referring to FIG. 3, various functional elements included in the controller 30 and the machine guidance device 50 are described. FIG. 3 is a functional block diagram for illustrating exemplary structures of the controller 30 and the machine guidance device 50.

Within the embodiment, the machine guidance device 50 receives outputs from the boom angle sensor S1, the arm angle sensor S2, the bucket angle sensor S3, the body inclination sensor S4, the input apparatus D1, and the controller 30, and outputs the various commands respectively to the sound output apparatus D2, the display apparatus D3, and the memory apparatus D4. The machine guidance device 50 includes a posture detection unit 51 a difference calculation unit 52, a sound output control unit 53, and a display control unit 54. The controller 30 and the machine guidance device 50 are mutually connected through a controller area network (CAN).

The posture detection unit 51 is a functional element of detecting the posture of the attachment. Within the embodiment, the posture detection unit 51 detects the posture of the drilling attachment based on detection values respectively of the boom angle sensor S1, the arm angle sensor S2, the bucket angle sensor S3, and the body inclination sensor S4. Specifically, the posture detection unit 51 acquires coordinates corresponding to points on the drilling attachment on a reference frame. The reference frame is a coordinate system having the origin at a point on the upper-part swiveling body 3. For example, the reference frame is a three-dimensional orthogonal coordinate system having an X-axis being a straight line on a horizontal face parallel to an elongating direction of the drilling attachment and a Z-axis being a vertical line vertical to the X-axis. The above points on the drilling attachment include a point corresponding to a position of the tip (a claw end) of the bucket 6.

The difference calculation unit 52 acquires a difference between a current position of the bucket 6 and a target position of the bucket 6. Within the embodiment, the difference calculation unit 52 acquires the difference between the current position of the bucket 6 and the target position of the bucket 6 based on the posture of the drilling attachment detected by the posture detection unit 51 and target land form information described below. Specifically, the difference calculation unit 52 acquires a distance between the position of the tip of the bucket 6 and the surface of the target land form in the vertical direction as the difference. The difference may be a distance, a shortest distance, or the like between the position of the tip of the bucket 6 and the surface of the target land form in the horizontal direction.

The target land form information relates to a land form at a time of completing the construction. The target land form information is input through the input apparatus D1 and stored in the memory apparatus D4. Specifically, the operator actually operates the shovel to move the position of the tip of the bucket 6 to the reference point. The reference point is, for example, one point on a reference face that is formed by a rotary laser survey device. The operator inputs the known distance between the reference point and the surface of the target land form in the vertical direction as a present difference at the present time. Alternatively, in a case where the slope of embankment is constructed, the operator may move the position of the tip (a tip position) of the bucket 6 to the reference point using a top of slope being the uppermost end of the slope, and thereafter may input the gradient of the slop relative to the X-axis of the reference frame. Alternatively, the operator may merely conduct an operation (for example, a push of a predetermined button)) for reporting the move of the tip position of the bucket 6 to the reference point to the machine guidance device 50. Hereinafter, such an input by the operator of the target land form information is referred to as a target setup process.

The shovel includes the boom angle sensor S1, the arm angle sensor S2, and the bucket angle sensor S3. Therefore, the machine guidance device 50 can calculate the height of the height of the claw end of the bucket 6 without a position shift as long as the position and the posture of a crawler 1*c* do not change even if the posture of the drilling attachment changes. Therefore, even if the posture of the drilling attachment changes, it is possible to accurately acquire the difference between the present position and the target position. However, if the position or the posture of the crawler 1C changes, the height of a contact area of the crawler 1C shifts to cause a positional relationship between the height of the claw end of the bucket 6 and the reference point to be changed. If the construction is done without reflecting this change in the positional relationship, a construction surface different from the target construction surface is formed. Therefore, in a case where the position or the posture of the crawler 1C is changed, it is required to perform the target setup process again. The difference calculation unit 52 is required to acquire the difference between the present position and the target position based on the reference point acquired again.

The sound output control unit 53 controls the content of sound output from the sound output apparatus D2. Within the embodiment, the sound output control unit 53 causes the sound output apparatus D2 to output an intermittent sound as a guidance sound in a case where the difference acquired by the difference calculation unit 52 becomes a predetermined value or less. The sound output control unit 53 shortens an output interval (the length of no sound portions) of the intermittent sound as the difference decreases. In a case where the difference is zero, said differently, in a case where the tip position of the bucket 6 matches the surface of the target land form, the sound output control unit 53 may output continuous sound (the intermittent sound having an output interval of zero) from the sound output apparatus D2. In a case where positive and negative of the difference are inversed, the sound output control unit 53 may change the tone pitch (the frequency) of the intermittent sound. The difference becomes positive in a case where the tip position of the bucket 6 is vertically above the surface of the target land form.

The machine guidance device 50 manages whether a target setup process is conducted. Within the embodiment, the machine guidance device 50 uses a target setup completion flag stored in an internal memory of the machine guidance device 50 to manage whether the target setup process is conducted. Regarding the value of the target setup completion flag, a value "0" being the initial value indicates that the target setup process is not conducted yet, and a value "1" indicates that the target setup process has been conducted. The machine guidance device 50 sets the value of the target setup completion flag to be "1" in a case where the target setup process is conducted, and sets the value of the target setup completion flag to be "0" in a case where a reset command is received from the controller 30. In a case where the traveling operation is conducted, the swivel operation is conducted, and an ignition key is turned off, the controller 30 outputs the reset command. In the case where the value of the target setup completion flag is "0", said differently, the target setup process has not been conducted, the machine guidance device 50 may be set so as not to conduct the machine guidance.

The display control unit 54 controls the content of various image information displayed on the display apparatus D3. Within the embodiment, the display control unit 54 causes the display apparatus D3 to display the relationship between the posture of the drilling attachment detected by the posture detection unit 51 and the target land form information. Specifically, the display control unit 54 causes the display apparatus D3 to display a CG image of the bucket 6 and a cross-sectional view of the target land form, which are viewed from a side (in the direction of the Y-axis), and a CG image of the bucket 6 and a cross-sectional view of the target land form, which are viewed from the back (in the direction of the X-axis).

Next, the controller 30 is described in detail. Within the embodiment, the controller 30 includes a pause determining unit 31, a resume determining unit 32, and an alert unit 33. The controller 30 receives an output from the gate lock lever D5 and an output from the pressure sensor 29, and outputs various commands respectively to the machine guidance device 50, the gate lock valve D6, and the engine controller D7.

A pause determining unit 31 is a function element determining whether the operation of the shovel is temporarily paused. Within the embodiment, the pause determining unit 31 determines whether a period (hereinafter, referred to as a "non-operation period") while the shovel is not operated based on the output from the pressure sensor continues during a predetermined period of time or longer. In a case where the non-operation period is determined to continue during the predetermined period of time or longer, the pause determining unit 31 determines that the operation of the shovel is temporarily paused. At this time, the pause determining unit 31 outputs a guidance sound pause command to the machine guidance device 50. The machine guidance device 50 receives the guidance sound pause command and thereafter limits the output of the guidance sound. Specifically, the intermittent sound output from the sound output apparatus D2 is weakened or stopped. This is to prevent the intermittent sound as the guidance sound from being continuously output despite that the operation of the shovel is temporarily paused. Specifically, the machine guidance device 50 stops sending the sound output command to the sound output apparatus D2. Alternatively, the machine guidance device 50 may reduce or eliminate the sound volume of the sound output apparatus D2 while the sound output command is continuously sent to the sound output apparatus D2.

Alternatively, the pause determining unit 31 may output the guidance sound pause command to the machine guidance device 50 when the controller 30 outputs an auto idling command to the engine controller D7. Specifically, the pause determining unit 31 determines whether the non-operation period continues for a predetermined period of time T2 or longer. In a case where the non-operation period is determined to continue for the predetermined period of time T2 or longer, the pause determining unit 31 outputs an auto idling command to the engine controller D7 and outputs a guidance sound pause command to the machine guidance device 50.

Alternatively, the pause determining unit 31 may output the guidance sound pause command to the machine guidance device 50 when the controller 30 outputs the auto idling stop command to the engine controller D7. Specifically, the pause determining unit 31 determines whether the non-operation period continues for a predetermined period of time T3 (T3≥T2) or longer. In a case where the non-operation period is determined to continue for the predetermined period of time T3 or longer, the pause determining unit 31 outputs an auto idling stop command to the engine controller D7 and outputs a guidance sound pause command to the machine guidance device 50.

Alternatively, in a case where the pause determining unit 31 determines that the gate lock lever is in the second state, the pause determining unit 31 may output the guidance sound pause command to the machine guidance device 50. Specifically, in a case where the gate lock lever D5 in the first state is determined to be switched to the second state based on the state signal output from the gate lock lever D5, the pause determining unit 31 outputs a shutoff command to the gate lock valve D6 and outputs a guidance sound pause command to the machine guidance device 50.

Further, the controller 30 may manage whether the guidance sound is paused. Within the embodiment, the controller 30 uses a pause flag stored in the internal memory of the controller 30 to manage whether the guidance sound has been paused. A value "0" being an initial value of the pause flag indicates that the guidance sound is not paused. A value "1" of the pause flag indicates that the guidance sound is paused. The controller 30 sets the value of the pause flag to "1" in a case where the guidance sound is paused, and sets the value of the pause flag to "0" in a case where the guidance sound is resumed. Specifically, the pause determining unit 31 sets the value "1" to the pause flag in a case where it is determined that the operation of the shovel is temporarily paused, and thereafter sets the value "0" in a case where it is determined that the operation of the shovel is resumed.

The resume determining unit 32 is a function element of determining whether an output of the guidance sound, which has been automatically paused, is resumed. Within the embodiment, the resume determining unit 32 determines whether the shovel is operated based on the output from the pressure sensor 29 in the case where the pause flag has the value "1". In a case where the shovel is determined to be operated, the resume determining unit 32 sets the value "0" to the pause flag and outputs the guidance sound resume command to the machine guidance device 50. If the value of the target setup completion flag is "1", the machine guidance device 50 that has received the guidance sound resume command automatically resumes the output of the intermittent sound corresponding to the difference being the distance in the vertical direction between the tip position of the bucket 6 and the surface of the target land form without forcing the operator to conduct the target setup process again.

Alternatively, in the case where the value of the pause flag is "1" and it is determined that the gate lock lever D5 in the second state is determined to be switched over into the first state, the resume determining unit 32 sets the value "0" to the pause flag and may output the guidance sound resume command to the machine guidance device 50. Specifically, in a case where the gate lock lever D5 in the second state is determined to be switched to the first state based on the state signal output from the gate lock lever D5, the resume determining unit 32 sets the value "0" to the pause flag, and may output a connection command to the gate lock valve D6 and may output a guidance sound resume command to the machine guidance device 50.

In a case where a period of time of pausing the output of the guidance sound exceeds a predetermined period of time, the resume determining unit 32 may output a reset command to the machine guidance device 50. This is to make the operator conduct the target setup process again.

The alert unit 33 is a function element of reporting a possible discontinuity of the accurate guidance performed by using a machine guidance function in a case where a predetermined event occurs. Within the embodiment, in a case where the position or the posture of the lower-part traveling body 1 is determined to be changed after the target setup process is conducted, the alert unit 33 reports the possible discontinuity of the accurate guidance. This is because of the determination that a shift exists between a posture (hereinafter, referred to as a "reference position") achievable by the shovel when the tip position of the bucket 6 is matched with the reference point in the target setup process and a current achievable posture currently achievable by the shovel (The posture of the shovel same as the reference posture cannot be realized by any operation of the shovel). The change in the position and the posture of the lower-part traveling body 1 is brought about by, for example, the inertia at a time of stopping moving or swiveling the lower-part traveling body 1, sinking of the shovel on soft ground, or the like. Within the embodiment, an alert is not done even in a case where the swivel operation is conducted after the target setup process is conducted. This is because the posture of the shovel can be returned to the reference posture by returning the swivel angle position to the original position. The alert unit 33 may send an alert in a case where the swivel operation is conducted after the target setup process is performed.

Specifically, the alert unit 33 may determine whether the traveling operation is conducted based on the output from the pressure sensor 29. In a case where the traveling operation is determined to be conducted, the alert unit 33 may output an alert command to the machine guidance device 50 to report an occurrence of a position change in the lower-part traveling body 1. The machine guidance device 50 receiving the alert command causes the display apparatus D3 to display the possible discontinuity of the accurate guidance if the value of the target setup completion flag is "1". In this case, the machine guidance device 50 may additionally or alternatively cause the sound output apparatus D2 to output sound to inform of the possible discontinuity of the accurate guidance.

Further, the alert unit 33 may determine whether the output from the body inclination sensor S4 reaches the first predetermined value. Within the embodiment, the first predetermined value is set when the target setup process is performed. Specifically, the first predetermined value includes a threshold value acquired by adding a preset adjusted value to the detected value in the body inclination sensor S4 at a time of completing the target setup process, and a threshold value acquired by subtracting a preset adjusted value from the detected value in the body inclination sensor S4 at a time of completing the target setup process. The above adjusted value is differently set for an occasion where the swivel operation is conducted and an occasion where the swivel operation is not conducted. Typically, the adjusted value for the occasion where the swivel operation is conducted is set larger than the adjusted value for the occasion where the swivel operation is not conducted. This is because, in a case where the shovel is positioned on an inclined surface, the inclined angle of the upper-part swiveling body 3 (the body inclination sensor S4) varies during swiveling. The first predetermined value is differently set for the occasion where the swivel operation is conducted and the occasion where the swivel operation is not conducted. In a case where the output from the body inclination sensor S4 is determined to reach the first predetermined value, the alert unit 33 may output the alert command to the machine guidance device 50 to inform an occurrence of a change in the posture of the lower-part traveling body 1. Within the embodiment, the alert unit 33 receives the output of the body inclination sensor S4 through the machine guidance device 50 through a CAN. However, the alert unit 33 may directly receive the output of the body inclination sensor S4.

Alternatively, the alert unit 33 may determine whether the output of an acceleration sensor (not illustrated) attached to the shovel reaches a second predetermined value. Within the embodiment, the second predetermined value is previously stored in the internal memory or the like. The acceleration sensor can measure at least one of an acceleration in the horizontal direction and an acceleration in the vertical direction. Therefore, the second predetermined value may be determined for each of the acceleration in the horizontal direction and the acceleration in the vertical direction. The acceleration sensor may be the body inclination sensor S4 or a sensor attached to the upper-part swiveling body 3 other than the body inclination sensor S4. In a case where the output from the acceleration sensor is determined to reach the second predetermined value, the alert unit 33 may output the alert command to the machine guidance device 50 to inform an occurrence of a change in the position or the posture of the lower-part traveling body 1.

Alternatively, the alert unit 33 may determine whether a moving distance detected by a positioning apparatus (not illustrated) attached to the shovel reaches a third predetermined value. Within the embodiment, the third predetermined value is previously stored in the internal memory or the like. Specifically, the alert unit 33 may determine whether the moving distance after completing the target setup process reaches a third predetermined value based on a detected value in the positioning apparatus at a time of completing the target setup process and a current detected value currently detected by the positioning apparatus. The moving distance may be any one of an actual distance, a horizontal distance, and a vertical distance. Therefore, the third predetermined value may be stored so as to correspond to each of the actual distance, the horizontal distance, and the vertical distance. The positioning apparatus is, for example, a GNSS receiver. In a case where the moving distance is determined to reach the third predetermined value, the alert unit 33 may output the alert command to the machine guidance device 50 to inform an occurrence of a change in the position of the lower-part traveling body 1.

In a case where the alert unit 33 determines that a change in the position or the posture of the lower-part traveling body 1 is determined to occur, the alert unit 33 may cause the machine guidance device 50 to stop conducting the machine guidance. Specifically, in a case where the alert unit 33 determines that the change in the position or the posture of the lower-part traveling body 1 is determined to occur, the alert unit 33 may output a reset command to the machine guidance device 50. The machine guidance device 50 receiving the reset command may set the value of a target setup completion flag to be "0" to cause the machine guidance not to be operated until the target setup process is performed again.

Figure 4:
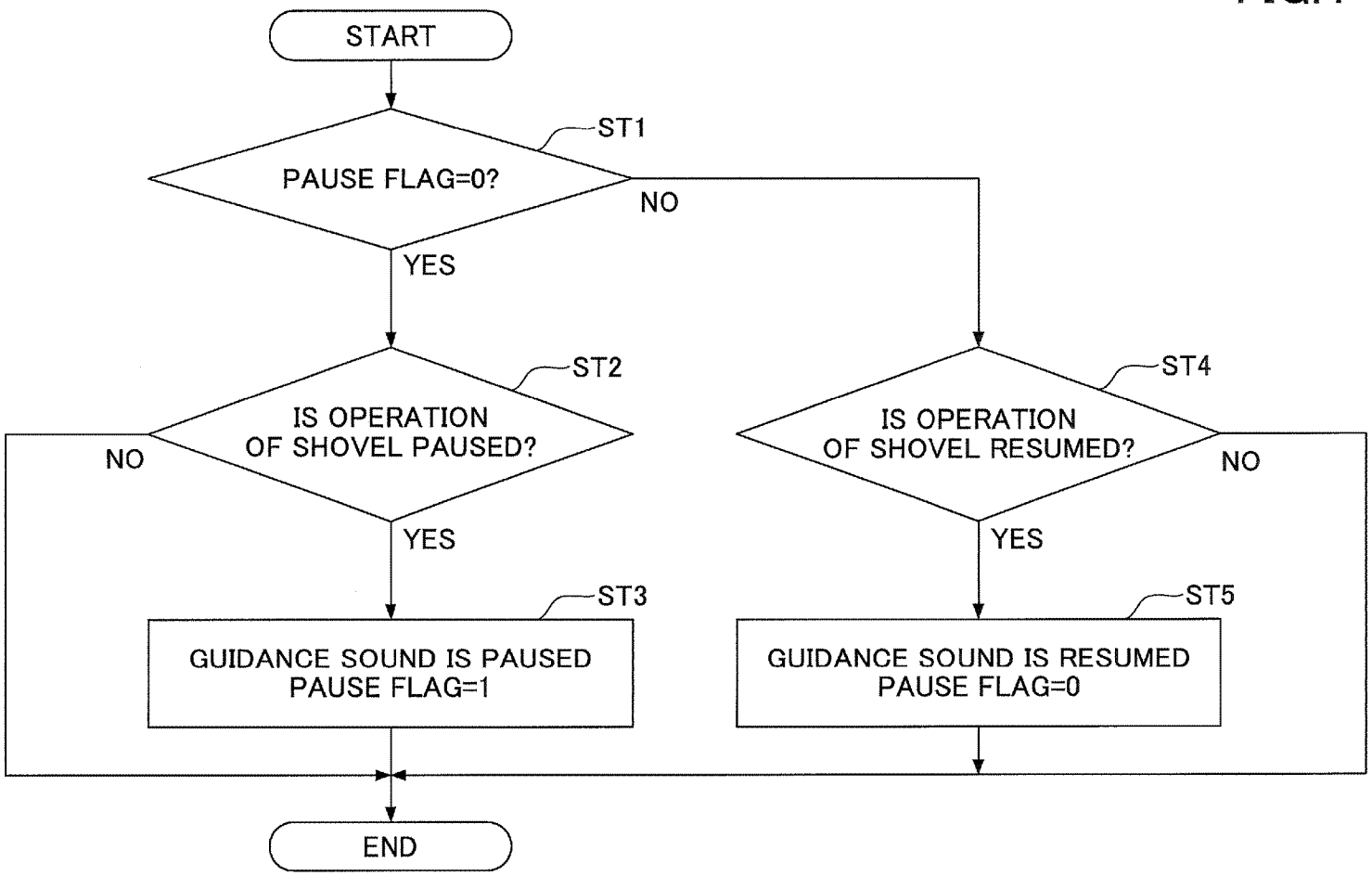
FIG. 4 is a flow chart illustrating a flow of guidance sound control process.

Referring to FIG. 4, described next is a process (hereinafter, referred to as a "guidance sound control process") performed by the controller 30 to pause or resume the guidance sound. FIG. 4 is a flow chart illustrating an exemplary flow of the guidance sound control process. The controller 30 repeatedly performs this guidance sound control process at a predetermined cycle. The target setup process is already completed. Said differently, after the tip (the claw end) position of the bucket 6 has been matched with the reference point, the difference between the current position and the target position of the claw end of the bucket 6 of the shovel in the reference posture can be acquired.

At first, the controller 30 refers to the pause flag stored in the internal memory of the controller 30 to determine whether the value of the pause flag is "0" (step ST1). Said differently, the controller 30 determines whether the guidance sound has been paused.

In a case where the value of the pause flag is determined to be "0", namely, the guidance sound is determined not to be paused (YES of step ST1), the pause determining unit 31 of the controller 30 determines whether the operation of the shovel has not been temporarily paused (step ST2). Within the embodiment, the pause determining unit 31 determines whether the non-operation period continues for a predetermined period of time T1 or longer based on the output of the pressure sensor 29.

In a case where the operation of the shovel has been temporarily paused (YES of step ST2), the pause determining unit 31 outputs the guidance sound pause command to the machine guidance device 50, and sets the value of the pause flag to be "1" (step ST3). The machine guidance device 50 receiving the guidance sound pause command limits the output of the guidance sound. Specifically, the intermittent sound output from the sound output apparatus D2 is weakened or stopped.

In a case where the operation of the shovel has not been temporarily paused (NO of step ST2), the pause determining unit 31 does not output the guidance sound pause command to the machine guidance device 50, does not set the value of the pause flag to be "1", and ends guidance sound control process.

In a case where the value of the pause flag is determined not to be "0", namely, the guidance sound is determined to be already paused (NO of step ST1), the resume determining unit 32 of the controller 30 determines whether the operation of the shovel has been resumed (step ST4).

In a case where the operation of the shovel has been resumed (YES of step ST4), the resume determining unit 32 outputs the guidance sound resume command to the machine guidance device 50, and resets the value of the pause flag to be "0" (step ST5). The machine guidance device 50 receiving the guidance sound resume command resumes the output of the guidance sound. Here, if the value of the target setup completion flag is "1", the machine guidance device 50 resumes the output of the intermittent sound corresponding to the difference being the distance in the vertical direction between the tip position of the bucket 6 and the surface of the target land form without forcing the operator to conduct the target setup process again.

With the above structure, the controller 30 automatically pause the output of guidance sound in a case where the operator temporarily pauses the operation of the shovel to prevent the guidance sound from being continuously emitted. For example, the controller 30 can prevent the guidance sound from interrupting telephone conversation in a case where the operator temporarily pauses the operation of the shovel. Further, the operator is not forced to manually stop the guidance sound. Therefore, the operator is prevented from being annoyed by this manual stop.

Further, the controller 30 can automatically resume the output of the paused guidance sound when necessary. Therefore, the operator is not forced to manually resume the guidance sound.

Further, the controller 30 can temporarily pause only the guidance sound without stopping machine guidance. Therefore, the operator is not forced to do a target setup process again when the paused output of the guidance sound is resumed.

Figure 5:
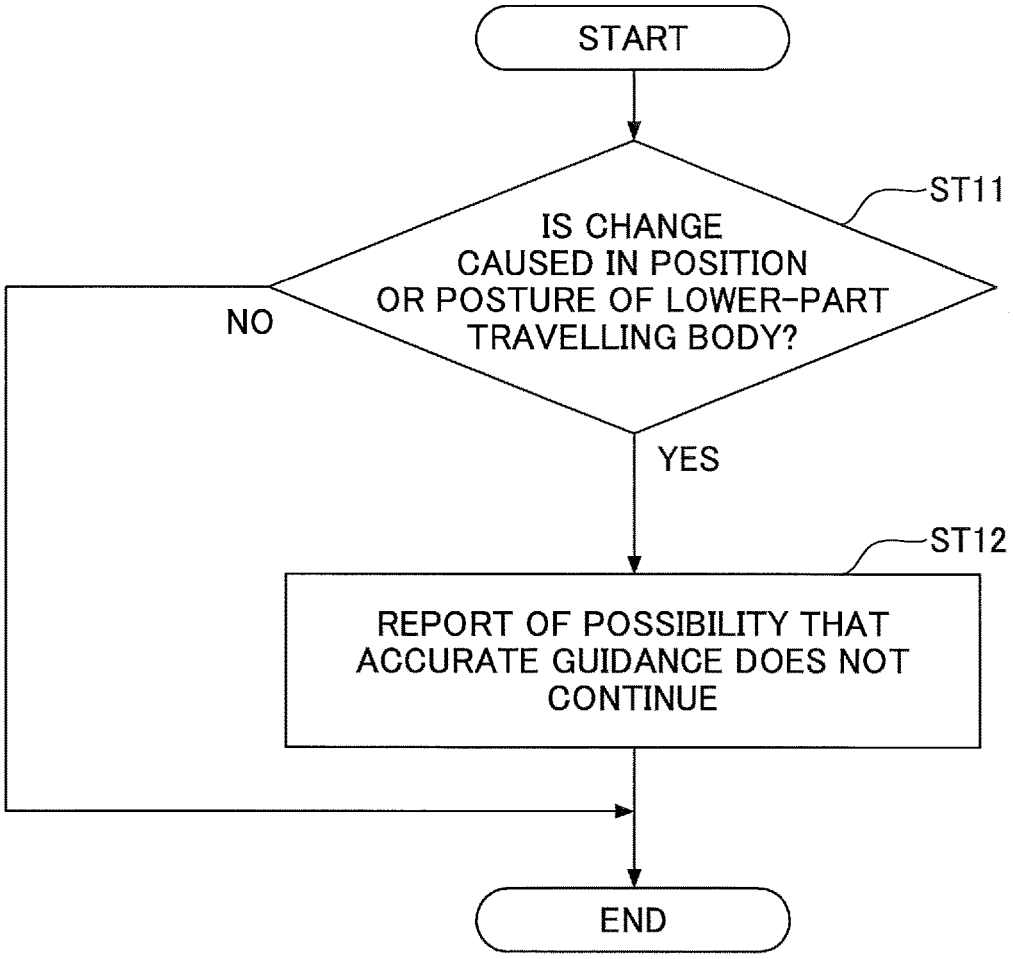
FIG. 5 is a flow chart illustrating a flow of an alert process.

Referring to FIG. 5, described next is a process (hereinafter, referred to as an "alert process") of reporting a possible discontinuity of the accurate guidance by the controller 30 when necessary. FIG. 5 is a flowchart illustrating an exemplary flow of an alert process. The controller 30 repeatedly performs this alert process in a predetermined cycle. Further, the target setup process has been already completed. Said differently, it is after matching the tip (the claw end) of the bucket 6 with the reference point, and the difference between the present position and the target position of the claw end of the bucket 6 of the shovel in the reference posture can be acquired. At first, the alert unit 33 of the controller 30 determines whether a change occurs in the position or the posture of the lower-part traveling body 1 (step ST11). For example, the alert unit 33 determines whether a traveling operation is conducted based on the output from the pressure sensor 29 to determine whether a change occurs in the position or the posture of the lower-part traveling body 1.

If the change is determined to occur in the position or the posture of the lower-part traveling body (YES in step ST11), the alert unit 33 reports the possible discontinuity of the accurate guidance to the operator (step ST12). In a case where the traveling operation is determined to be conducted, the alert unit 33 may output an alert command to the machine guidance device 50 to report an occurrence of a position change in the lower-part traveling body 1. The machine guidance device 50 receiving the alert command causes the display apparatus D3 to display the possible discontinuity of the accurate guidance if the target setup process has been already performed. In this case, the machine guidance device 50 may additionally or alternatively cause the sound output apparatus D2 to output sound to inform of the possible discontinuity of the accurate guidance.

With this structure, the controller 30 can report the possible discontinuity of the accurate guidance to the operator in a case where the change is determined to occur in the position or the posture of the lower-part traveling body. The operator can take an appropriate measure such as another target setup process. Therefore, it is possible to prevent an erroneous construction from being conducted.

Figure 6:
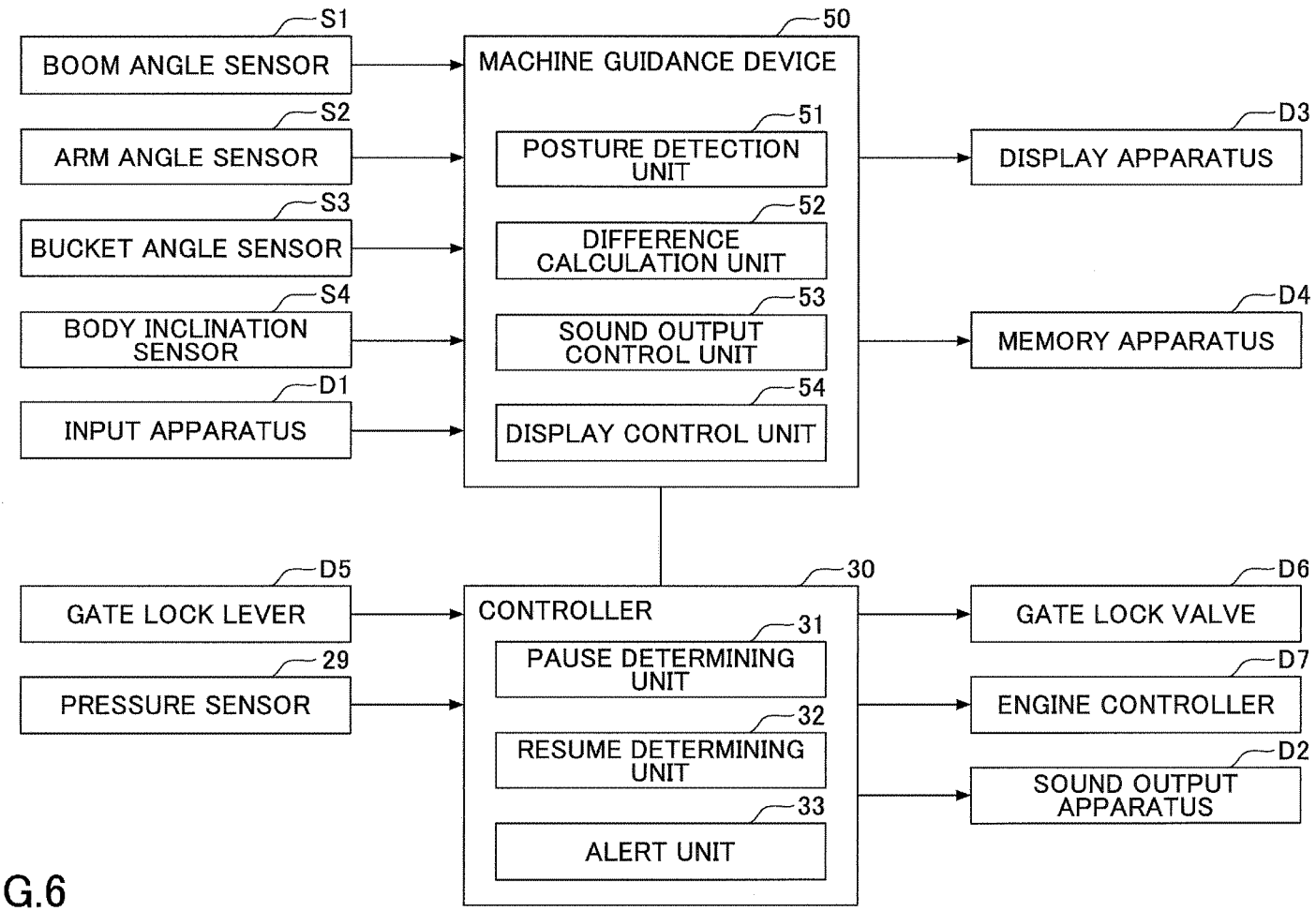
FIG. 6 is a functional block diagram for illustrating other exemplary structures of the controller and the machine guidance device.

Referring to FIG. 6, another structural example of the controller 30 and the machine guidance device 50 is described. FIG. 6 is a functional block diagram for illustrating other exemplary structures of the controller 30 and the machine guidance device 50.

The structure illustrated in FIG. 6 differs from the structure illustrated in FIG. 3 at a point that the sound output apparatus D2 is not connected to the machine guidance device 50 but to the controller 30. Therefore, explanation of common parts is omitted and different parts are described in detail.

According to the structure illustrated in FIG. 6, the machine guidance device 50 outputs a sound output command to the sound output apparatus D2 through the controller that is connected through the CAN. Therefore, in a case where it is determined that the operation of the shovel is temporarily paused, the pause determining unit 31 of the controller 30 can limit the output of the guidance sound without outputting the guidance sound pause command to the machine guidance device 50.

Specifically, the pause determining unit 31 shuts off a sound signal sent from the machine guidance device 50 to the sound output apparatus D2 or directly controls the sound output apparatus D2 such as a decrease of the sound volume of the sound output apparatus D2 to limit the output of the guidance sound.

In a manner similar thereto, in a case where it is determined that the operation of the shovel is resumed, the resume determining unit 32 of the controller 30 can resume the output of the guidance sound without outputting the guidance sound resume command to the machine guidance device 50.

Specifically, the resume determining unit 32 releases the shut-off of the sound signal sent from the machine guidance device 50 to the sound output apparatus D2 or directly controls the sound output apparatus D2 such as a return (an increase) of the sound volume of the sound output apparatus D2 to resume the output of the guidance sound.

According to the structure illustrated in FIG. 6, the display apparatus D3 is maintained to be connected to the machine guidance device 50. Here, both the sound output apparatus D2 and the display apparatus D3 may be connected not to the machine guidance device 50 but to the controller 30.

With the above structure, the controller 30 in the structure illustrated in FIG. 6 can substantialize an effect similar to the effect of the controller 30 in the structure illustrated in FIG. 3.

Figure 7:
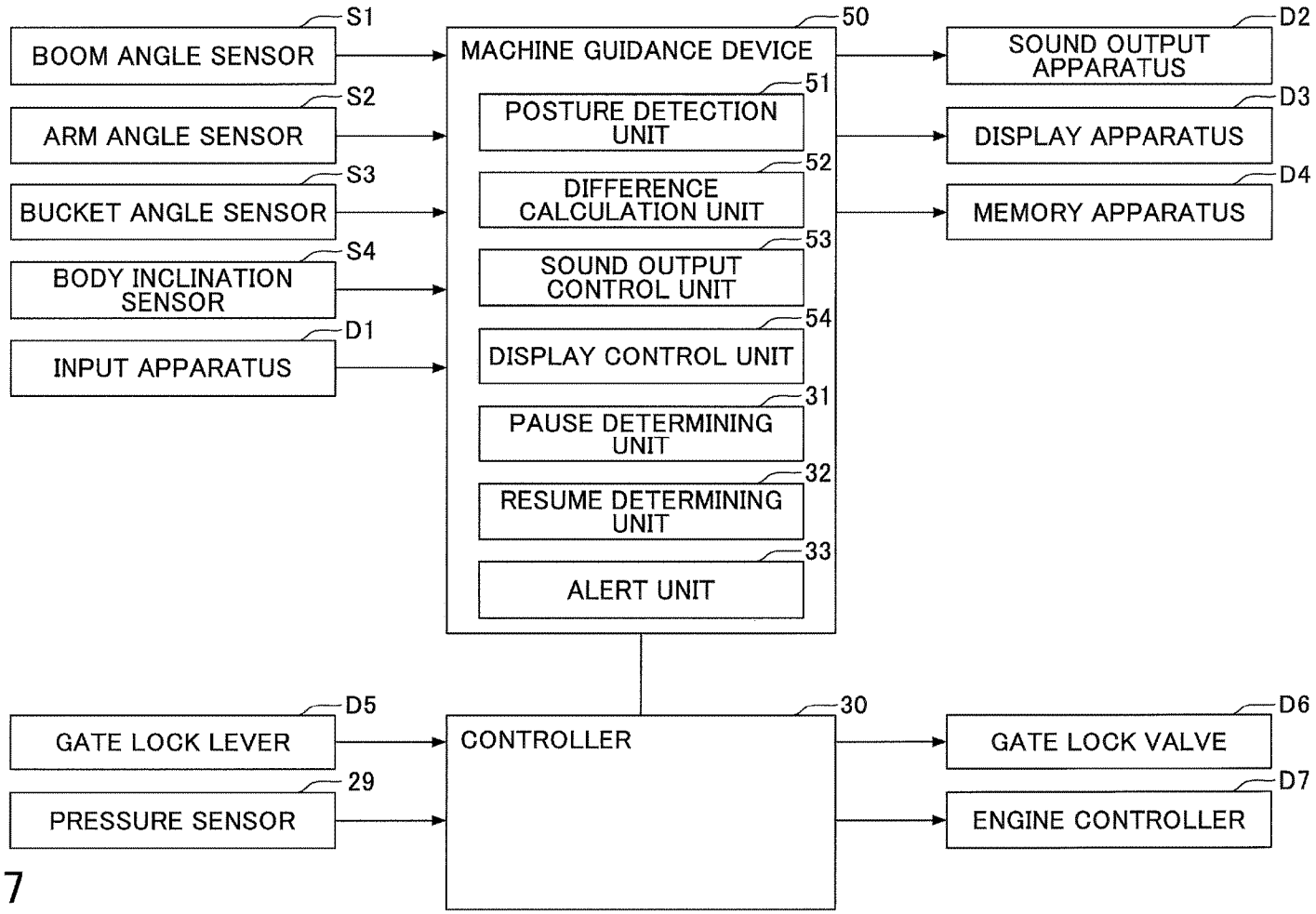
FIG. 7 is a functional block diagram for illustrating other exemplary structures of the controller and the machine guidance device.

Referring to FIG. 7, another structural example of the controller 30 and the machine guidance device 50 is described. FIG. 7 is a functional block diagram for illustrating other exemplary structures of the controller 30 and the machine guidance device 50.

The structure illustrated in FIG. 7 differs from the structure illustrated in FIG. 3 at a point that the machine guidance device 50 includes the pause determining unit 31, the resume determining unit 32, and the alert unit 33. Therefore, explanation of common parts is omitted and different parts are described in detail.

According to the structure illustrated in FIG. 7, the machine guidance device 50 receives outputs from the gate lock lever D5 and the pressure sensor 29 through the controller 30 that is connected through the CAN. Therefore, in a case where the operation of the shovel is determined to be temporarily paused based on the outputs from the gate lock lever D5 and the pressure sensor 29 through the CAN, the pause determining unit 31 in the machine guidance device 50 can instantaneously limit the guidance sound without generating the guidance sound pause command. Therefore, in a case where the operation of the shovel is determined to be resumed based on the outputs from the gate lock lever D5 and the pressure sensor 29 through the CAN, the resume determining unit 32 in the machine guidance device 50 can instantaneously resume the guidance sound without generating the guidance sound pause command. Referring to FIG. 7, functions of sending various commands to the gate lock valve D6 and the engine controller D7 that are performed in the controller 30 remain in the controller 30 as are.

With the above structure, the controller 30 in the structure illustrated in FIG. 7 can substantialize an effect similar to the effect of the controller 30 in the structure illustrated in FIG. 3.

Figure 8:
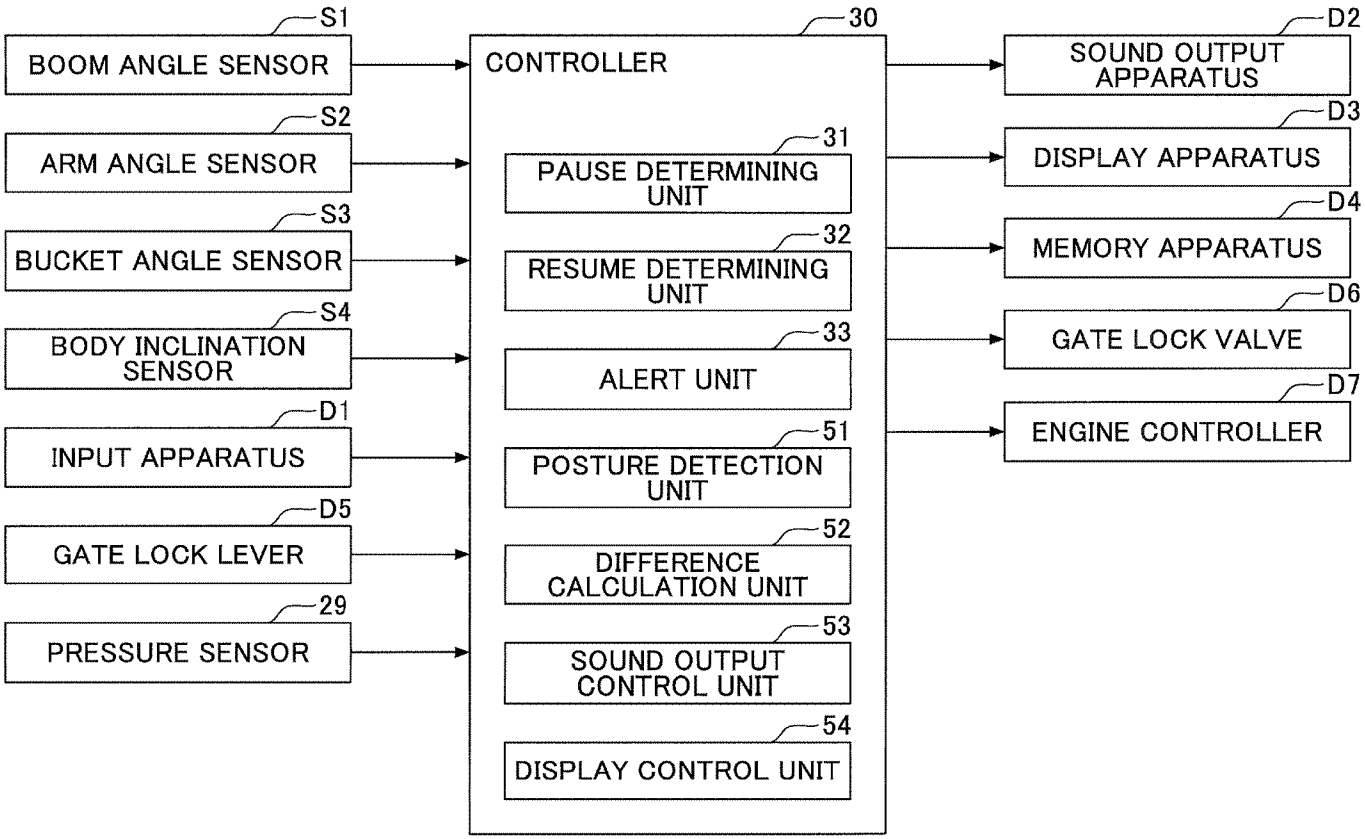
FIG. 8 is a functional block diagram for illustrating an exemplary structure of the controller.

Referring to FIG. 8, described next is another more exemplary structure of the controller 30. FIG. 8 is a functional block diagram for illustrating another exemplary structure of the controller 30.

The structure illustrated in FIG. 8 differs from the structure illustrated in FIG. 3 at a point that the machine guidance device 50 is integrated into the controller. However, the functions of the structural elements are the same.

Referring to FIG. 8, all four function elements, namely, the posture detection unit 51, the difference calculation unit 52, the sound output control unit 54, and the display control unit 54, are integrated into the controller 30. However, only a part of the four function elements may be integrated into the controller 30. In this case, the machine guidance device having remaining function elements among from the four function elements is connected to the controller 30.

With the above structure, the controller 30 in the structure illustrated in FIG. 8 can substantialize an effect similar to the effect of the controller 30 in the structure illustrated in FIG. 3.

Although the invention has been described in detail with respect to preferable embodiments, the present invention is not to be thus limited but is to be construed as embodying all modifications and alternative constructions without departing from the scope of the present invention.

For example, within the above embodiment, the controller 30 weakens or stops the guidance sound in a case where the operation of the shovel temporarily pauses. However, the present invention is not limited to this structure. For example, in a case where the state of the shovel is a predetermined state such that the shovel is determined to be during the traveling operation or during the swivel operation, the controller 30 may weaken or stop the guidance sound.

Within the above embodiment, the controller 30 causes only the output of the guidance sound to stop if necessary and causes the display apparatus D3 to continuously display the guidance display. However, the present invention is not limited to this structure. For example, the controller 30 may cause the guidance display on the display apparatus D3 to be output in addition to the pause of the output of the guidance sound.

Further, within the embodiment, the sound output control unit 53 makes an output interval (the length of the no sound portions) of the intermittent sound shorter as the difference acquires as the distance between the tip position of the bucket 6 and the surface of the target land form in the vertical direction becomes shorter. However, the present invention is not limited to this structure. The sound output control unit 53 may output the guidance sound in an arbitrary mode as long as the operator hearing the guidance sound can recognize the size of the difference. For example, the sound output control unit 53 may increase the tone pitch (the frequency) of the intermittent sound as the difference becomes smaller.

Explanation of reference symbols is as follows:

1: lower-part traveling body
1A, 1B: hydraulic traveling motor
2: swivel mechanism
3: upper-part swiveling body
4: boom
5: arm
6: bucket
7: boom cylinder
8: arm cylinder
9: bucket cylinder
10: cabin
11: engine
14: main pump
15: pilot pump
16: high-pressure hydraulic line
17: control valve
21: hydraulic swiveling motor

25: pilot line
26: operation apparatus
26A, 26B: lever
26C: pedal
27, 28: hydraulic line
29: pressure sensor
30: controller
31: pause determining unit
32: resume determining unit
33: alert unit
50: machine guidance device
51: posture detection unit
52: difference calculation unit
53: sound output control unit
54: display control unit
S1: boom angle sensor
S2: arm angle sensor
S3: bucket angle sensor
S4: body inclination sensor
D1: input apparatus
D2: sound output apparatus
D3: display apparatus
D4: memory apparatus
D5: gate lock lever
D6: gate lock valve
D7: engine controller

What is claimed is:

1. A shovel comprising:

a lower-part traveling body;

an upper-part swiveling body installed in the lower-part traveling body so as to be rotatable relative to the lower-part traveling body; and an attachment attached to the upper-part swiveling body, wherein the shovel performs a machine guidance function of reporting a visual report or an audible report of a value of a difference between a present position of an end attachment and a target position of the end attachment, and wherein the shovel includes a control apparatus reporting that the machine guidance function may not be continuously accurate in a case where it is determined that a predetermined event occurs.

2. The shovel according to claim 1, wherein the control apparatus determines that the predetermined event occurs in a case where it is determined that a change occurs in a position of the lower-part traveling body or a posture of the lower-part traveling body, and reports that the machine guidance function may not be continuously accurate.

3. A shovel comprising:

a lower-part traveling body;

an upper-part swiveling body installed in the lower-part traveling body so as to be rotatable relative to the lower-part traveling body; and an attachment attached to the upper-part swiveling body, wherein the shovel performs a machine guidance function of reporting a visual report or an audible report of a value of a difference between a present position of an end attachment and a target position of the end attachment, and wherein the shovel includes a control apparatus reporting that the machine guidance function may not be continuously accurate in a case where it is determined that a predetermined event occurs, wherein the control apparatus determines that the predetermined event occurs in a case where at least one of (i), (ii), (iii), and (iv) is satisfied:

(i) it is determined that a traveling operation is conducted, (ii) it is determined that an inclination sensor detection value of an inclination sensor attached to the shovel reaches a first predetermined value, (iii) it is determined that an acceleration sensor detection value of an acceleration sensor attached to the shovel reaches a second predetermined value, and (iv) it is determined that a moving distance detected by of a positioning apparatus attached to the shovel reaches a third predetermined value, and reports that the machine guidance function may not be continuously accurate.

4. The shovel according to claim 3, wherein the first predetermined value at a time of conducting a swivel operation is different from the first predetermined value at a time of not conducting the swivel operation.

5. The shovel according to claim 3, wherein the acceleration sensor detection value is acceleration in a horizontal direction or a vertical direction.

* * * * *